US005092697A

United States Patent [19]

McKenna

[11] Patent Number: 5,092,697

[45] Date of Patent: Mar. 3, 1992

[54] WEB HANDLING METHOD AND APPARATUS

[75] Inventor: Thomas G. McKenna, Kettering, Ohio

[73] Assignee: Monarch Marking Systems, Inc., Dayton, Ohio

[21] Appl. No.: 590,268

[22] Filed: Sep. 28, 1990

[51] Int. Cl.[5] ..... B41J 11/26

[52] U.S. Cl. ..... 400/621.1; 101/227; 225/3; 225/106; 242/56.2

[58] Field of Search ..... 400/621.1, 483; 101/226, 227, 224; 225/3, 97, 98, 99, 100, 106; 226/196; 242/56.1, 56.2, 56.3, 56.4, 56.5, 56.6, 56.7, 56.8, 56.9

[56] References Cited

U.S. PATENT DOCUMENTS

| | | | |
|---|---|---|---|
| 375,728 | 1/1888 | Brissaut | 242/56.2 |
| 3,783,083 | 1/1974 | Senkins . | |
| 3,783,783 | 1/1974 | Hamisch, Sr. | 101/226 |
| 4,177,730 | 12/1979 | Schriber et al. | 101/226 |
| 4,538,517 | 9/1985 | Michalik et al. | 101/227 |
| 4,823,694 | 4/1989 | Siegenthaler | 101/227 |

FOREIGN PATENT DOCUMENTS

| | | | |
|---|---|---|---|
| 2754180 | 6/1979 | Fed. Rep. of Germany | 101/226 |
| 1017581 | 1/1966 | United Kingdom . | |
| 1277934 | 6/1972 | United Kingdom | 225/3 |

*Primary Examiner*—Eugene H. Eickholt
*Attorney, Agent, or Firm*—Joseph J. Grass

[57] ABSTRACT

There is disclosed a web handling apparatus including a printer for printing on longitudinally extending multi-portion webs, with the web including a plurality of longitudinally extending web portions and connected at a longitudinal line of weakening between each adjacent pair of web portions, each web portion including record members, guide structure for causing adjacent web portions to move along different paths or planes to effect tearing and resultant separation of the web portions at each line of weakening, and a rewinder for drawing on the separated web portions and winding them into separate rolls.

21 Claims, 3 Drawing Sheets

WEB HANDLING METHOD AND APPARATUS

BACKGROUND OF THE INVENTION

1. Field of the Invention

This invention relates to the art of web handling apparatus and methods of handling webs.

2. Brief Description of the Prior Art

U.S. Pat. No. 3,783,783 granted Jan. 8, 1974 to Paul H. Hamisch, Jr. is made of record.

It is a feature of the invention to increase the productivity of a printer by simultaneously printing transversely across a web having longitudinally extending lines of weakening, and tearing the web into web portions each having printed data, wherein the tearing is effected by passing the web portion in different paths about a guide.

It is another feature of the invention to provide improved, simple, low-cost method and apparatus for tearing a web into a plurality of web portions.

It is still another feature of the invention to provide improved method and apparatus for producing multiple rolls of custom-printed labels in an in-line arrangement using a single printer.

It is yet another feature of the invention to provide an improved simple, low-cost, easy to assemble, portable apparatus having relatively few parts for separating a wide web into a plurality of narrow webs or web portions.

Description of the Preferred Embodiment

Figure 1:
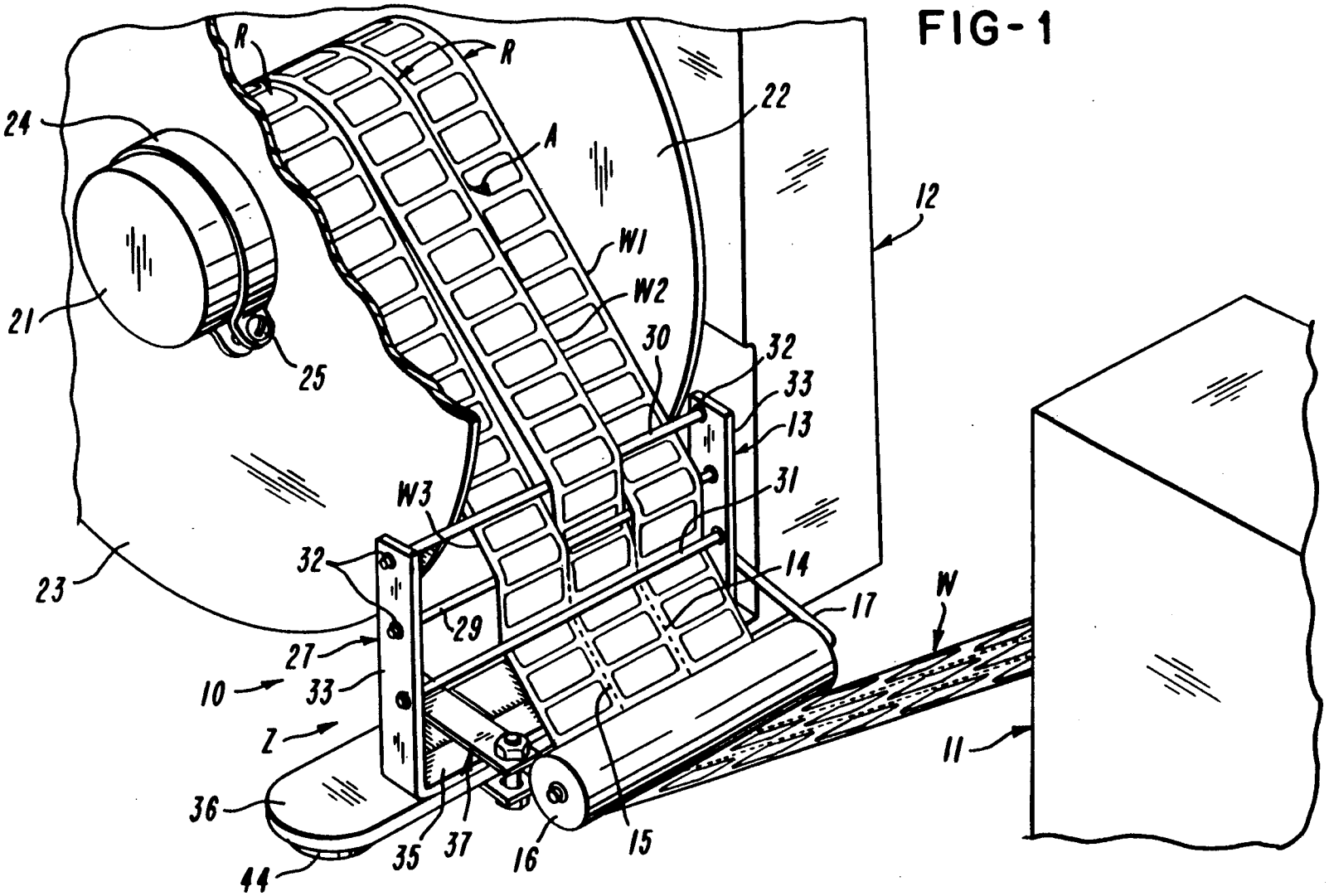
FIG. 1 is a perspective view of web handling apparatus of the invention.

Referring to FIG. 1, there is shown a web handling apparatus generally indicated 10. The apparatus 10 is shown to include a printer generally and diagrammatically indicated at 11, a rewinder generally indicated at 12, and a device 13 comprising guide structure for separating a multi-portion web W into web portions W1, W2 and W3. The printer 11 and the rewinder 12 are supported on a flat surface S of a table or portable cart. The longitudinally extending web W is shown passing downstream from the printer 11 with the longitudinally extending web portions W1, W2 and W3 in tact. The device 13 is located at a zone Z downstream of the printer 11 and upstream of the rewinder 12 in an in-line arrangement. The web portions W1 and W2 are connected to each other at a longitudinal line of weakening 14, and the web portions W2 and W3 are connected to each other at a longitudinal line of weakening 15. The web portions W1, W2 and W3 are shown to comprise composite label webs with carrier webs on release liners C1, C2 and C3 to which labels L are releasably secured by pressure sensitive adhesive A. The web portions W1, W2 and W3 could as well be comprised of tag web portions instead of composite pressure sensitive label web portions.

The printer 11 has a print head (not shown) which simultaneously prints data D on all the labels L in each transverse row across the web W. The data D can include bar codes, human readable numbers such as prices, and the like. While all the labels L are printed, only two transverse rows R1 and R2 are shown as having printing to prevent the drawings from being cluttered. The printer 11 can take the form of a printer disclosed in U.S. Pat. No. 4,776,714 granted to Sugiura et al on Oct. 11, 1988 incorporated herein by reference and sold by Monarch Marking Systems, Inc., Dayton, Ohio U.S.A. under its 9400® Series trademark.

The web W passes beneath and in contact with a dancer roll 16 which is part of the rewinder 12. The dancer roll 16 is rotatable mounted on a lever arm 17 for generally vertical movement. The dancer roll 17 senses slackness in the web W and descends as the web W becomes slack and is raised by the web W as tension in the web W increases. The rewinder 12 is sold by Monarch Marking Systems, Inc. under its trademark 415.

Figure 2:
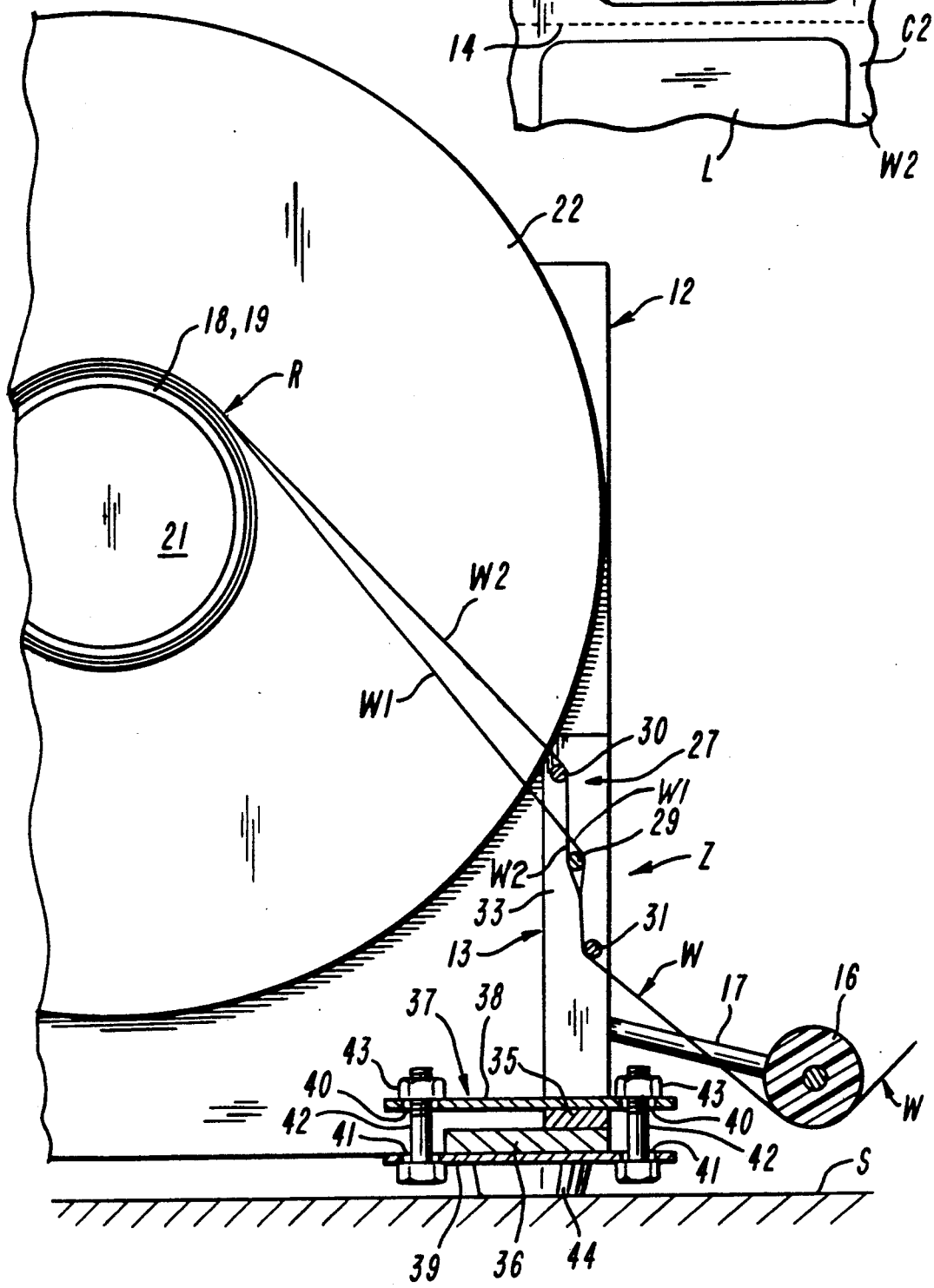
FIG. 2 is an elevational sectional view of a portion of the apparatus shown in FIG. 1.
Figure 3:
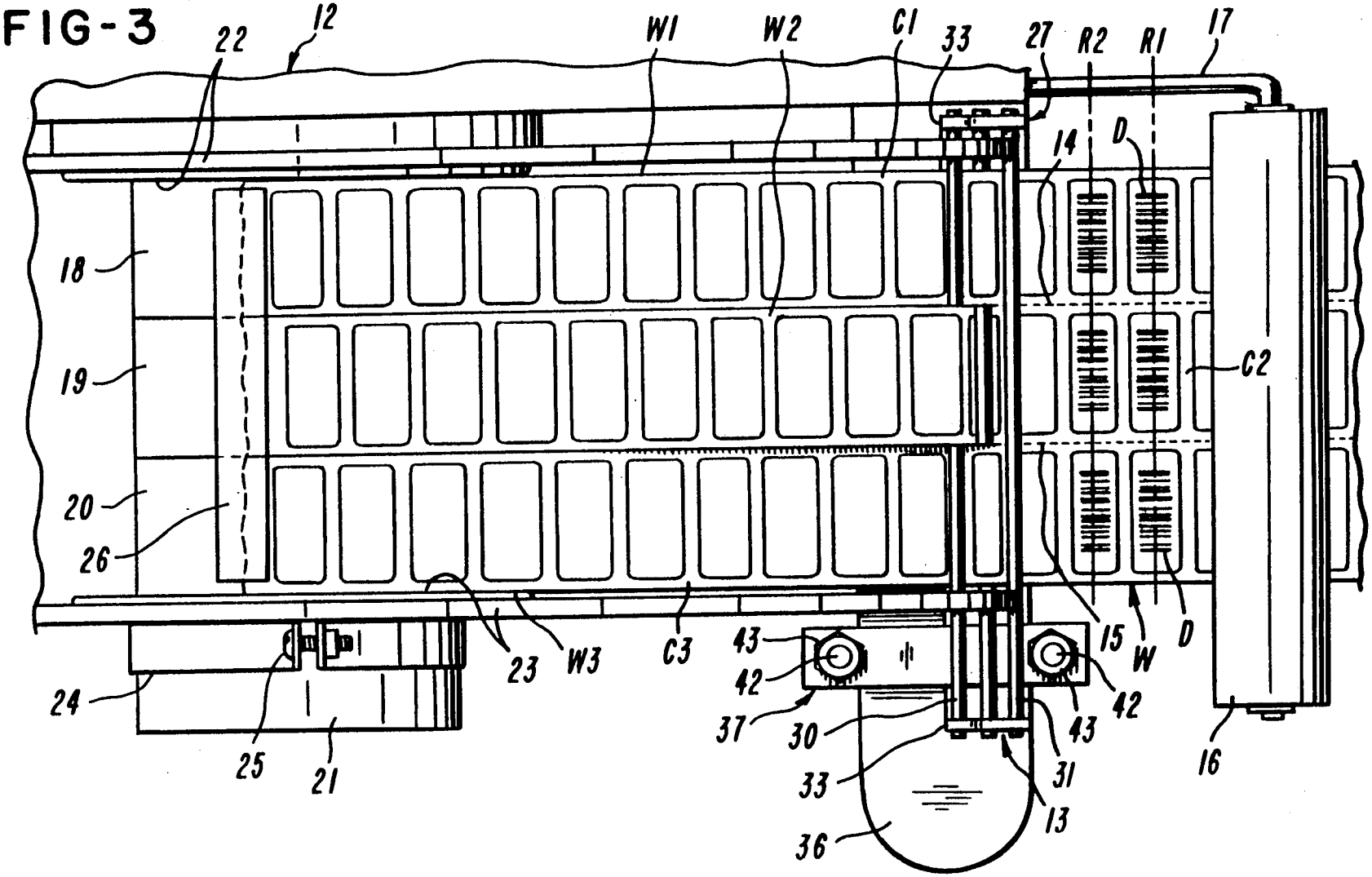
FIG. 3 is a top plan view showing the web portions secured to the cores.

FIGS. 2 and 3 show the manner in which the web portions W1, W2 and W3 are wound into roll form. Cores 18, 19 and 20 are slid onto a hub 21. The one side of the core 18 abuts a side plate 22. The sides of the cores 18, 19 and 20 abut each other. The one side of the core 20 abuts the side plate 23. A clamp 24 on the hub 21 controlled by a screw 25 enables the cores 18, 19 and 20 to be held clamped together frictionally so that they rotate together as a unit. The cores 18, 19 and 20 are driven as a unit as the motor driven hub 21 is rotated in response to the dancer roller 16 having sensed a slack condition in the web W. When the dancer roll 16 is elevated sufficiently due to tautness in the web W, the power to the rewinder motor (not shown) is interrupted and the hub 21 and the cores 18, 19 and 20 cease to be driven. It is apparent that rotation of the hub 21 causes tension in the web W to increase due to the pulling or drawing force exerted by the cores 18, 19 and 20 on the web portions W1, W2 and W3. As shown in FIG. 3, the web portion W1, W2 and W3 are suitably attached to the cores 18, 19 and 20 as by a piece of pressure sensitive tap 26. FIG. 3 shows the initial threading of the web portions at the beginning of a run at which the free terminal ends of the web portions W1, W2 and W3 are attached to cores 18, 19 and 20.

With reference again to FIG. 1, the device 13 is shown to include an upright U-shaped frame 27 and spaced guides 29, 30 and 31. The guides are shown to comprise guide rods preferred rotatably mounted in bearings 32. The bearings 32 are received in spaced arms 33 of the frame 27. The frame 27 also includes a bight 35. The bight 35 is clamped to a base member 36 of the rewinder 12 by spaced clamps generally indicated at 37. The clamps 37 are identical and one is shown in detail in FIG. 2. Each clamp 37 includes a pair of plates 38 and 39 having respective elongate slots 40 and 41. Bolts 42 pass through slots 40 and 41 and threadably receive nuts 43. As shown, the base member 36 has an elastomeric pad 44 which supports the rewinder 12 on the surface S.

With reference to FIG. 1, the device 13 is located at a zone Z downstream of the printer 11 and upstream of the rewinder 12. The web W is shown to pass from beneath the dancer roll 16 to a position behind the guide 31. The web portions W1, W2 and W3 are initially threaded through the device 13 so that the web portions W1 and W3 pass in front of the guide 29 while the web portion W2 passes behind the guide 29. From there the web portions W1 and W3 pass behind the guide 30 and the web W2 passes in front of the guide 30. In FIG. 2 the section line is taken along the line of weakening 15 so only the webs W1 and W2 are shown; the in tact web W contacts the left side of the guide 31, the web portion W2 contacts the left side of the guide 29, the web portion W1 contacts the right side of the guide 29, and the web portion W2 contacts the right side of the guide 30. As shown, the tearing of the web W at the lines of weakening 14 and 15 occurs between the guides 31 and 29 but close to the guide 29 when using the preferred form of weakening. The web portions W1 and W3 are confined to move in one curved path or curved plane and the web portion W2 is confined to move in a different curved path or curved plane, as shown in FIGS. 1 and 2. The web portions W1 and W2 undulate in one path and the web portion W2 undulates in another path opposite to the one path. As adjacent pairs of web portions W1 and W2, and W2 and W3 are confined or trained to move progressively in different paths about the guide 29, the web portions W1, W2 and W3 are torn progressively at the lines of weakening 14 and 15. The web portions W1, W2 and W3 are progressively wound onto the respective cores 18, 19 and 20 until the rolls R reach the desired size, whereupon the web portions W1, W2 and W3 are cut downstream of the guide 30, that is, between the guide 30 and the outer wraps of the web portions W1, W2 and W3 on the respective roll R. It should be noted that as the size of the rolls R increase, the inclination of the web portions W1 and W3 downstream of the guide 30 and the inclination of the web portion W2 downstream of the guide 29 become steeper, that is, are closer to vertical. This does not, however, adversely affect the tearing action used to separate the web portions W1, W2 and W3.

When the rolls R have reached predetermined size, the rewinder 12 is stopped, the clamp 24 is loosened from the hub 21 by turning the screw 25, and the clamp 24 and the side plate 23 are slid off the hub 21. The individual cores 18, 19 and 20 with their respective wound web portions W1, W2 and W3 can thus be slid off the hub 21. It is apparent that the printer 11 has been utilized to print simultaneously web portions W1, W2 and W3 for three separate label rolls.

Figure 4:
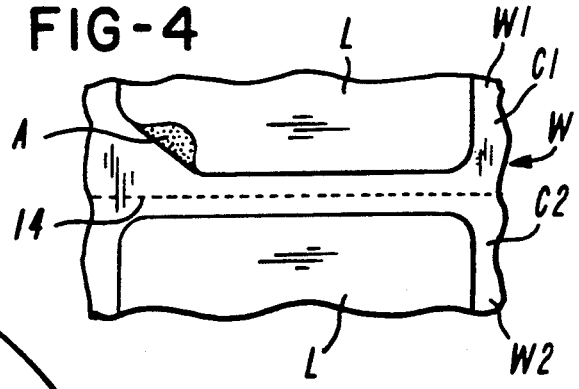
FIG. 4 is a fragmentary view showing a portion of the web with a line of weakening.

FIG. 4 shows a fragmentary portion of the W and its line of weakening 14. The line of weakening 15 is the same as the line of weakening 14. The weakening at 14 and 15 is preferably made by making very short, closely and uniformly spaced knife cuts through the web W. In the illustrated embodiment the knife cuts are 0.008 inch (0.04 mm) long and there are seventy-two knife cuts per inch, that is about seventy-two knife cuts per 2.54 centimeters. However, other suitable weakening of the web to promote intentional tearing can be used such as scoring of the carrier web W, or by punching out material or chad, and the like.

While a web with three web portions W1, W2 and W3 is illustrated, the invention is useful when the web has two web portions such as W1 and W2 alone, or when the web has more than three web portions.

By way of example, not limitation, the guides 29, 30 and 31 are disposed in a flat plane. The center line of each guide 30 and 31 is 1.0 inch (2.54 cm) from the center line of the guide 29, and the guides 29, 30 and 31 are about 0.04 inch (4 mm) in diameter.

Although the separation of the web portions W1, W2 and W3 along the lines of weakening 14 and 15 is stated to be accomplished by "tearing", the expression "tearing" is not intended in any limiting sense.

Other embodiments and modifications of the invention will suggest themselves to those skilled in the art, and all such of these as come within the spirit of this invention are included within its scope as best defined by the appended claims.

I claim:

1. Web handling apparatus for handling a longitudinally extending multi-portion web having transverse rows of record members, wherein the web has a plurality of longitudinally extending web portions each having the record members and being connected at a longitudinal line of weakening between each adjacent pair of web portions, the apparatus comprising: a printer for printing data on the transverse rows of record members, a guide for tearing adjacent web portions of the web apart at the related line of weakening to separate the web into a plurality of web portions, the guide having different sides, the web portions being threaded so that adjacent web portions diverge and pass into contact with the different sides of the guide, and means for drawing on the separated web portions to cause the moving web to tear at each line of weakening as the web approaches the guide and as the guide causes the separated web portions to move in different paths and for thereafter winding the separated web portions into separate web rolls.

2. Web handling apparatus as defined in claim 1, wherein the guide comprises a rod.

3. Web handling apparatus as defined in claim 1, wherein the guide comprises a rotatably mounted rod.

4. Web handling apparatus for handling a longitudinally extending multi-portion web having transverse rows of record members, wherein the web has a plurality of longitudinally extending web portions each having the record members and being connected at a longitudinal line of weakening between each adjacent pair of web portions, the apparatus comprising: a printer for printing data on the transverse rows of record members, a first guide for tearing adjacent web portions of the web apart at the related line of weakening to separate the web into a plurality of web portions, the first guide having different sides, the web portions being threaded so that adjacent web portions diverge and pass into contact with the different sides of the first guide, means for drawing on the separated web portions to cause the moving web to tear at each line of weakening as the web approaches the first guide and as the first guide causes the separated web portions to move in different paths and for thereafter winding the separated web portions into separate web rolls, a second guide, and the web portion or portions which pass into contact with one of the different sides of the first guide thereafter pass into guided contact with the second guide.

5. Web handling apparatus as defined in claim 4, including a third guide for guiding the web to the first guide.

6. Web handling apparatus as defined in claim 5, wherein the first, second and third guides are disposed in a flat plane.

7. Web handling apparatus as defined in claim 5, wherein the drawing means includes a dancer roll in contact with the web between the printer and the third guide.

8. Web handling apparatus as defined in claim 4, wherein the first guide comprises a rod.

9. Web handling apparatus as defined in claim 4, wherein the first guide comprises a rotatably mounted rod.

10. Web handling apparatus as defined in claim 4, wherein the first guide comprises a first rod and the second guide comprises a second rod parallel to the first rod.

11. Web handling apparatus as defined in claim 4, wherein the first guide comprises a first rotatably mounted rod and the second guide comprises a second rotatably mounted rod spaced from the first rod.

12. Web handling apparatus as defined in claim 5, wherein the first, second and third guides comprise spaced rods.

13. Web handling apparatus as defined in claim 5, wherein the first, second and third guides comprise spaced rotatably mounted rods.

14. Web handling apparatus for handling a longitudinally extending multi-portion web having transverse rows of record members, wherein the web has a plurality of longitudinally extending web portions each having the record members and being connected at a longitudinal line of weakening between each adjacent pair of web portions, the apparatus comprising: a printer for printing data on the transverse rows of record members, means for defining paths for the web portions including a first guide and a second guide spaced from the first guide, the web portions being threaded so that adjacent web portions diverge and pass into contact with different sides of the first guide and so that certain of the web portions pass into guided contact with the second guide and the remainder are out of contact with the second guide in an alternating pattern, and means for drawing on the separated web portions to causes the moving web to tear at each line of weakening as the web approaches the first guide and wherein said certain web portions are guided by the second guide and for thereafter winding the separated web portions into separate web rolls.

15. Web handling apparatus as defined in claim 14, wherein the first guide comprises a rod.

16. Web handling apparatus as defined in claim 14, wherein the second guide comprise a rod.

17. Web handling apparatus as defined in claim 14, wherein the first guide comprises a first rod and the second guide comprises a second rod spaced from the first rod.

18. Web handling apparatus as defined in claim 14, wherein the second guide is a rotatably mounted rod.

19. Web handling apparatus as defined in claim 14, including a third guide for guiding the web to the first guide.

20. Web handling apparatus as defined in claim 19, wherein the first, second and third guides are disposed in a flat plane.

21. Web handling apparatus as defined in claim 19, wherein the drawing means includes a dancer roll in contact with the web between the printer and the third guide.

* * * * *